US008017021B1

(12) United States Patent
Staples

(10) Patent No.: US 8,017,021 B1
(45) Date of Patent: Sep. 13, 2011

(54) SLUDGE PROCESSING APPARATUS AND METHOD

(76) Inventor: Wesley A. Staples, Palatka, FL (US)

( * ) Notice: Subject to any disclaimer, the term of this patent is extended or adjusted under 35 U.S.C. 154(b) by 70 days.

(21) Appl. No.: 12/325,296

(22) Filed: Dec. 1, 2008

Related U.S. Application Data

(63) Continuation-in-part of application No. 11/345,607, filed on Feb. 1, 2006, now abandoned.

(51) Int. Cl.
*B02C 19/00* (2006.01)

(52) U.S. Cl. ..... 210/773; 210/173; 241/21; 241/29; 241/78; 241/152.2; 241/260.1

(58) Field of Classification Search ..... None
See application file for complete search history.

(56) References Cited

U.S. PATENT DOCUMENTS

| | | | | | |
|---|---|---|---|---|---|
| 2,098,026 | A | * | 11/1937 | Booge et al. | 423/83 |
| 2,635,104 | A | * | 4/1953 | Chayen | 554/23 |
| 2,929,504 | A | | 3/1960 | Lind et al. | |
| 3,168,291 | A | * | 2/1965 | Knoedler et al. | 366/142 |
| 3,355,260 | A | * | 11/1967 | Bruniche-Olsen | 127/43 |
| 3,547,577 | A | * | 12/1970 | Lovercheck | 53/511 |
| 3,565,634 | A | * | 2/1971 | Österman | 426/417 |
| 3,659,712 | A | | 5/1972 | Chaplin | |
| 3,711,296 | A | * | 1/1973 | LaWarre, Sr. | 426/499 |
| 3,756,372 | A | | 9/1973 | Mertens | |
| 3,766,586 | A | * | 10/1973 | Krickovich | 15/83 |
| 3,906,118 | A | * | 9/1975 | McFarland | 426/479 |
| 3,956,981 | A | * | 5/1976 | Pitt | 100/39 |
| 4,152,800 | A | | 5/1979 | Nilsmar | |
| 4,234,232 | A | * | 11/1980 | Smith et al. | 299/5 |
| 4,306,967 | A | | 12/1981 | Trautwein | |
| 4,357,230 | A | * | 11/1982 | Sibley et al. | 208/390 |
| 4,404,101 | A | | 9/1983 | Koch et al. | |
| RE31,631 | E | * | 7/1984 | McFarland | 241/74 |
| 4,464,246 | A | * | 8/1984 | Sanda | 208/428 |
| RE32,050 | E | * | 12/1985 | McFarland | 426/479 |
| RE32,060 | E | * | 12/1985 | McFarland | 426/55 |
| 4,588,559 | A | * | 5/1986 | Emmett | 422/162 |
| 4,634,524 | A | | 1/1987 | Huber | |
| 4,642,919 | A | | 2/1987 | Werner et al. | |
| 4,776,112 | A | | 10/1988 | Urbani | |
| 4,836,919 | A | | 6/1989 | Huber | |
| 4,871,449 | A | | 10/1989 | Lott | |
| 4,957,622 | A | | 9/1990 | Mims | |
| 5,007,590 | A | * | 4/1991 | Taylor | 241/25 |
| 5,028,010 | A | * | 7/1991 | Sansing | 241/101.8 |
| 5,048,766 | A | * | 9/1991 | Gaylor et al. | 241/65 |
| 5,167,841 | A | | 12/1992 | Mims | |
| 5,188,729 | A | | 2/1993 | Krofta | |

(Continued)

*Primary Examiner* — Robert James Popovics
(74) *Attorney, Agent, or Firm* — Allen, Dyer, Doppelt, Milbrath & Gilchrist, P.A.

(57) ABSTRACT

Material to be processed, such as sludge, is deposited into the trough having an auger operating at a rotational speed and direction so as to force the material received within the trough upstream against a rigid surface for breaking up the sludge. A cutting fluid is added to the trough for diluting the sludge and enhancing a flow of the broken up sludge downstream under a force of gravity, allowing the sludge to enter a chopper, where it is chopped to a desired consistency before being pumped to a desired location. The diluted sludge may be filtered prior to chopping. A hopper and cutter may be used to receive the unprocessed sludge for cutting prior to being deposited into the trough. As a result, sludge in ranges from soft to hard states is converted to a fluid form capable of being pumped.

16 Claims, 6 Drawing Sheets

U.S. PATENT DOCUMENTS 5,207,904 A * 5/1993 Abel ..... 210/252
5,378,375 A * 1/1995 Bache ..... 210/772
5,382,444 A * 1/1995 Roehrig et al. ..... 426/646
5,407,624 A * 4/1995 Engh et al. ..... 264/141
5,439,597 A * 8/1995 Allen ..... 210/767
5,456,893 A * 10/1995 Silver ..... 422/268
5,552,044 A 9/1996 Abel
5,558,473 A * 9/1996 Lindahl ..... 406/61
5,568,895 A * 10/1996 Webb et al. ..... 241/16
5,593,600 A * 1/1997 Solomon ..... 210/787
5,609,902 A * 3/1997 Inakuma et al. ..... 426/466
5,635,122 A * 6/1997 Vezzani ..... 264/115
5,707,016 A * 1/1998 Witsken ..... 241/46.06
5,709,842 A * 1/1998 Held et al. ..... 422/292
5,720,438 A * 2/1998 Devine et al. ..... 241/21
5,830,419 A * 11/1998 Held et al. ..... 422/307
5,833,922 A * 11/1998 Held et al. ..... 422/22
5,891,433 A * 4/1999 Silver ..... 424/123
5,906,793 A * 5/1999 Vezzani ..... 422/1
5,941,468 A * 8/1999 Lewis et al. ..... 241/17
6,039,874 A * 3/2000 Teran et al. ..... 210/605
6,045,070 A * 4/2000 Davenport ..... 241/60
6,190,566 B1 * 2/2001 Kolber ..... 210/744
6,248,985 B1 * 6/2001 Tomasello ..... 219/679
6,344,638 B1 * 2/2002 Tomasello ..... 219/770
6,588,690 B1 * 7/2003 Koenig ..... 241/65
6,960,293 B2 * 11/2005 Middleton ..... 210/173
6,997,328 B2 * 2/2006 Wilcher et al. ..... 210/519
7,178,262 B2 * 2/2007 Staples ..... 34/183
7,258,922 B2 * 8/2007 Hesse et al. ..... 428/403
2001/0013497 A1 * 8/2001 Kolber ..... 210/747
2002/0056690 A1 * 5/2002 Wegner ..... 210/773
2007/0080117 A1 * 4/2007 Heidel ..... 210/773

* cited by examiner

SLUDGE PROCESSING APPARATUS AND METHOD

CROSS-REFERENCE TO RELATED APPLICATIONS

This application claims the benefit of U.S. Utility patent application Ser. No. 11/345,607 having filing date of Feb. 1, 2006 for "Sludge Processing Apparatus and Method," which itself claims the benefit of U.S. Provisional Application No. 60/649,049 having filing date of Feb. 1, 2005. the disclosures of which are hereby incorporated by reference herein in their entirety, and all commonly owned.

FIELD OF THE INVENTION

The present invention generally relates to the field of waste products removal, and in particular to an apparatus and method for removing solid and liquid waste products such as sludge from liquid storage tanks.

BACKGROUND OF THE INVENTION

In today's industrialized, high tech world, we have new products being developed on a regular basis. Large industrial complexes blend, burn, mix, settle, ionize, dispose and utilize various processes in an attempt to eliminate resulting waste products in a low cost controlled manner.

In many cases, manufacturing plants end up with waste product in the form of sludge as the end product following the processing. This sludge can be on the bottom of ponds or as AGS tank bottoms. On occasion, sludge can be found in other locations after being removed from tanks or ponds. Some of the sludge has chemical, BTU, and/or a beneficial reuse value.

There is a need for efficiently and effectively removing sludge from its deposited location to a transport vehicle. One typical process includes use of a vacuum truck for suctioning the sludge. However, non-uniform sludge pieces are known to inhibit the effective removal using such a vacuuming.

By way of further example, many types of sludge such as that found in pulp and paper processing is "hard" and requires a more aggressive action typically used. Further, there is a need to process the sludge from liquor, a part of the normal mill liquor cycle, and return the sludge to a fluidized state such as "black liquor" and place the black liquor into the removal system for burning in a recovery boiler to generate energy, by way of example. There is a further need for portability, using hydraulics as a means of power and a dependable machine can be moved directly into tanks for processing directly at the point of the problem. Yet further, there is a need for processing sludge, from a generally soft state or hard state and delivering it to a vacuum truck which further delivers the processed sludge to a desired location.

SUMMARY OF THE INVENTION

In summary, embodiments of the present invention receive sludge in ranges from soft to hard states converts the sludge to a liquid form capable of being pumped. One apparatus according to the teachings of the present invention may comprise a trough carried inclined at an angle sufficient for permitting fluid to flow downstream from a first elevated end of the trough to a second end lower end as a result of gravity, the trough having an open top portion for receiving sludge and a rigid surface at the trough first end. An auger is carried within the trough for conveying sludge placed within the trough, wherein the sludge is driven against the rigid surface by operation of the auger for broking up the sludge through action of the auger forcing the sludge against the rigid surface. A chopper may be carried at the second end of the trough for receiving the sludge from the auger for a chopping of the sludge, and optionally a pump positioned for receiving the sludge from the chopper for removing the sludge therefrom. The apparatus may further comprise a platform, such as a skid, for supporting the trough. The auger may generally extend between the first and second ends of the trough.

A hopper may be positioned for receiving the sludge at a top end thereof and dispensing the sludge from a bottom end thereof into the trough at a location generally between the first and second ends thereof. Cutter blades may be fixed between the top and bottom ends of the hopper, the cuter blades receiving the sludge passing through the hopper and cutting the sludge as a result of the sludge falling through the cutter blades under gravitational forces. Further, a fluid injector may be employed and positioned for injecting a fluid into the trough for diluting the sludge being processed therein. A filter including slats may be positioned between the second end of the trough and the chopper for allowing a preselected size of sludge to enter the chopper. The chopper may comprise a circular chopping blade for chopping the sludge.

A method aspect of the invention may comprise depositing material to be processed into the trough at a location generally between the upstream and downstream ends, operating the auger at a rotational speed and direction so as to force the material received within the trough upstream, continuing to operate the auger for forcing the material against an upstream end surface of the trough for a breaking up thereof, optionally adding fluid to the trough for diluting the material and enhancing a flow of the broken up material downstream under a force of gravity, allowing the diluted material flowing downstream to enter the chopper, chopping the diluted material to a desired consistency, and optionally pumping the chopped material to a desired location. Further, the method may comprise filtering the diluted material prior to the chopping. Yet further, the method may comprise positioning the hopper for receiving the material and depositing the material to be processed into the hopper for the depositing into the trough, and optionally cutting the material prior to depositing the material into the trough.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
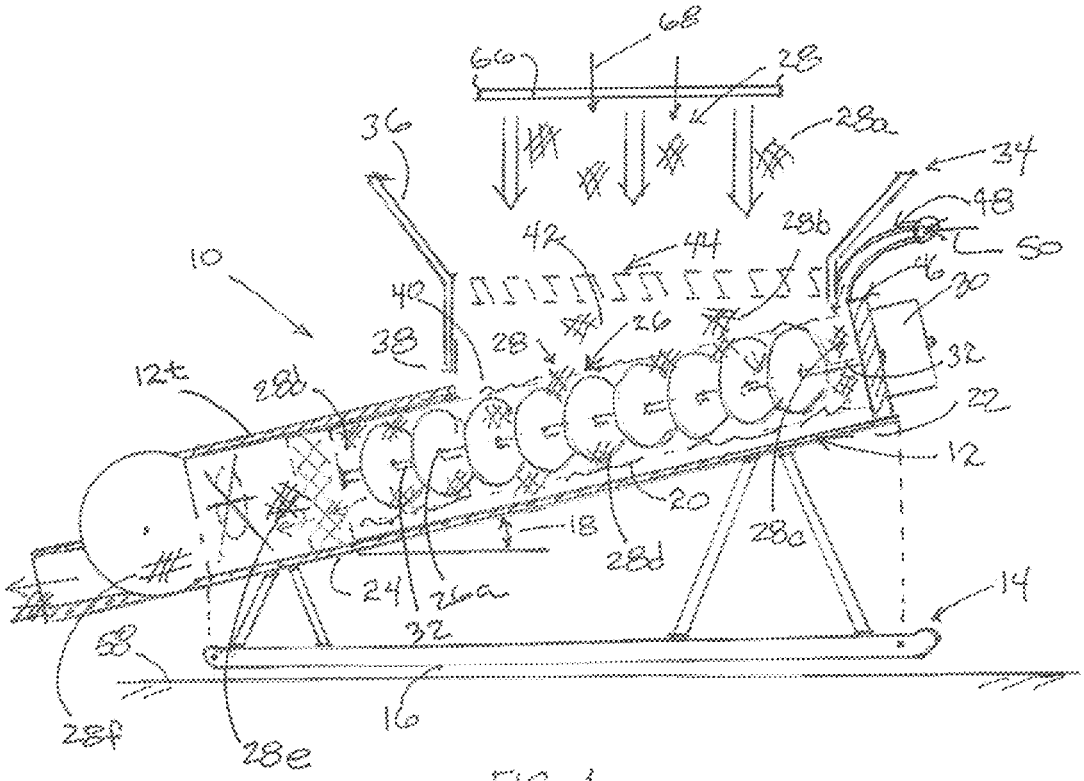
FIG. 1 is a diagrammatical partial cross sectional illustration of one embodiment in keeping with the teachings of the present invention.

By way of example for embodiments of the invention, reference is initially made to FIG. 1 diagrammatically illustrating one sludge processing apparatus 10, a trough 12 carried by a skid 14, wherein the trough is inclined relative to a supporting surface 16 for the skid at an angle 18 sufficient for permitting fluid 20 to flow downstream from a first elevated end 22 of the trough to a second end 24 as a result of gravitational forces.

With continued reference to FIG. 1, an auger 26 is carried within the trough 12 and extends between the first end 22 and the second end 24 for conveying material such as sludge 28 placed within the trough. A drive assembly 30 is carried at the first end 22 of the trough 12 and includes a motor (hydraulic as herein described by way of example) connected to a longitudinal shaft 32 of the auger 18 for controlling a rotational speed and direction of rotation of the auger and thus a flow of the sludge 28.

As herein described, the auger 26 is a device for conveying or moving material or liquid by means of a rotating helical flighting 28*a*. The material such as the sludge 28 is moved along the shaft 32, an axis of rotation. For portion of the auger 26, the helical flighting 26*a* is enclosed in a covered portion 12*t* of the trough 12, for other portions, the flighting 26*a* is only partially encased.

Figure 2:
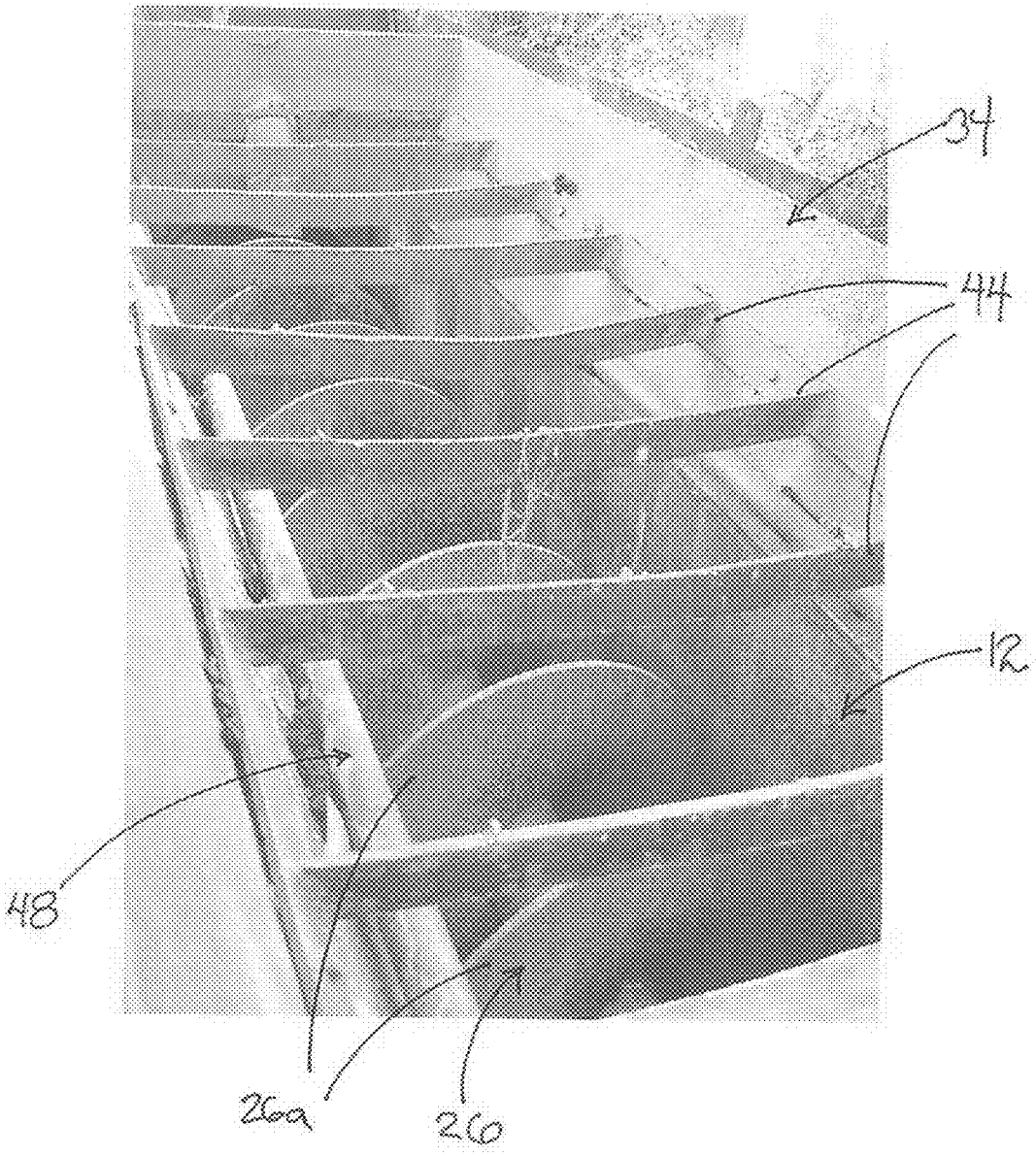
FIG. 2 is a partial top perspective view of a hopper and cutter blade portion of the embodiment of FIG. 1.

With continued reference to FIG. 1 and to FIG. 2, a hopper 34 is positioned for receiving the raw sludge 28*a* at a top flared end 36 of the hopper and dispensing the sludge 28 from a bottom end 38 into a top opened portion 40 of the trough 12 at a location 42 generally between the first and second ends 22, 24 of the trough. Cutter blades 44 are fixed between the top and bottom ends 36, 48 of the hopper 44. The cutter blades 44 receive the raw sludge 28*a* passing into the hopper 44 and cut the raw sludge into cut sludge 28*b* as a result of the sludge falling through the cutter blades under gravitational forces.

Figure 3:
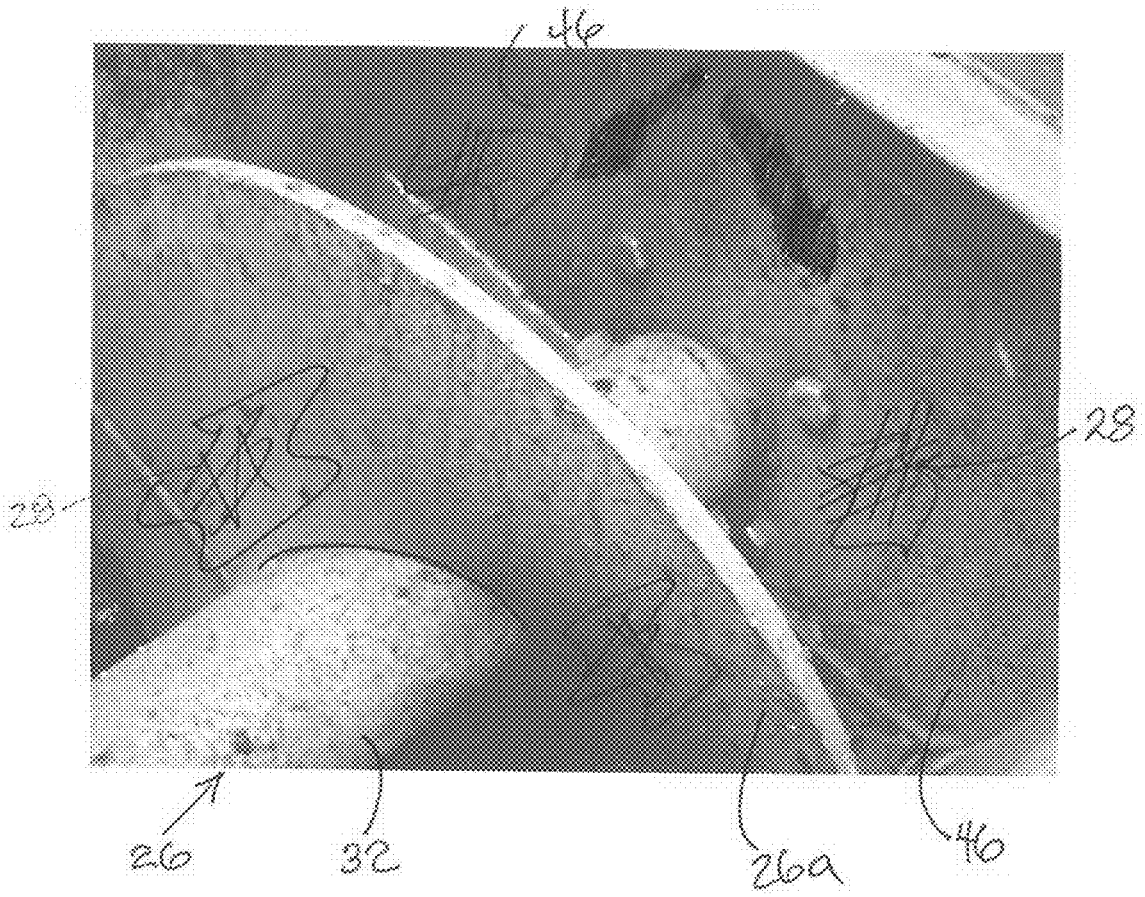
FIG. 3 is a partial perspective view of an auger portion compressing sludge against a rigid plate.

With continued reference to FIG. 1 and to FIG. 3, a plate 46, or comparable rigid surface, is positioned at an extreme trough first end 22 for receiving the sludge 28 driven against the plate by operation of the auger 26, wherein the cut sludge 28*b* is further broken up into broken sludge 28*c* through action of the auger forcing the cut sludge 28*b* against a surface of the plate. Blades of the auger 26 may be notched or tabbed (not shown) to create an increased chopping and mixing of the sludge by the auger for particle reduction.

With reference again to FIG. 1, a fluid injector 48 may be positioned proximate the plate 46 for injecting a fluid 50 (such as a cutter stock) into the trough 12 for diluting the sludge 28 being processed. As a result, the broken sludge 28*c*, having been compressed against the plate 46, becomes diluted sludge 28*d* and more freely flows downstream toward the trough second end 24. With continued reference to FIG. 1, the trough 12 includes a covered top wall 12*t* for generally enclosing the auger 26 at the trough second end 24, a discharge end, for desirably channeling the processed sludge 28 into a chopper 52.

Figure 4:
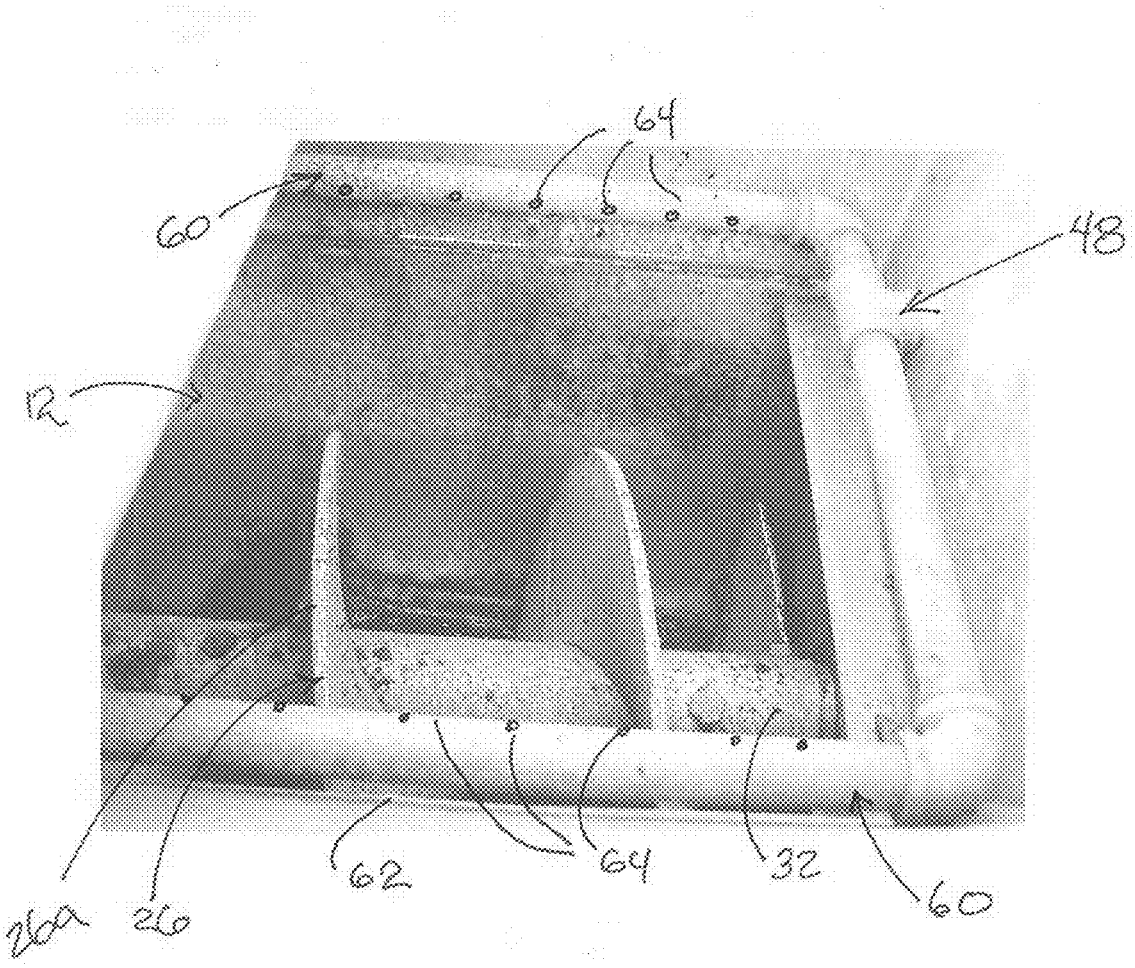
FIG. 4 is a partial perspective view of a fluid injector useful in injecting a cutting fluid into a trough of the embodiment illustrated in FIG. 1.

With reference to FIG. 4, the fluid injector 48 may comprise a conduit 60 such a pipe extending generally around a periphery 62 of the trough 12, with the conduit having a plurality of holes 64 or nozzles for distributing the diluting fluid 50, which fluid may be continuously or intermittently added to the trough 12 as desired. The holes 64 release the diluting liquid 50 at various points along the auger 26, the volume of the liquid being injected controlled to yield a desired thickness or consistency of the fluidized sludge mixture. The liquid 50 being injected is preferably turned downward to prevent spraying of fluidized sludge and liquid out of the trough 12.

Figure 5:
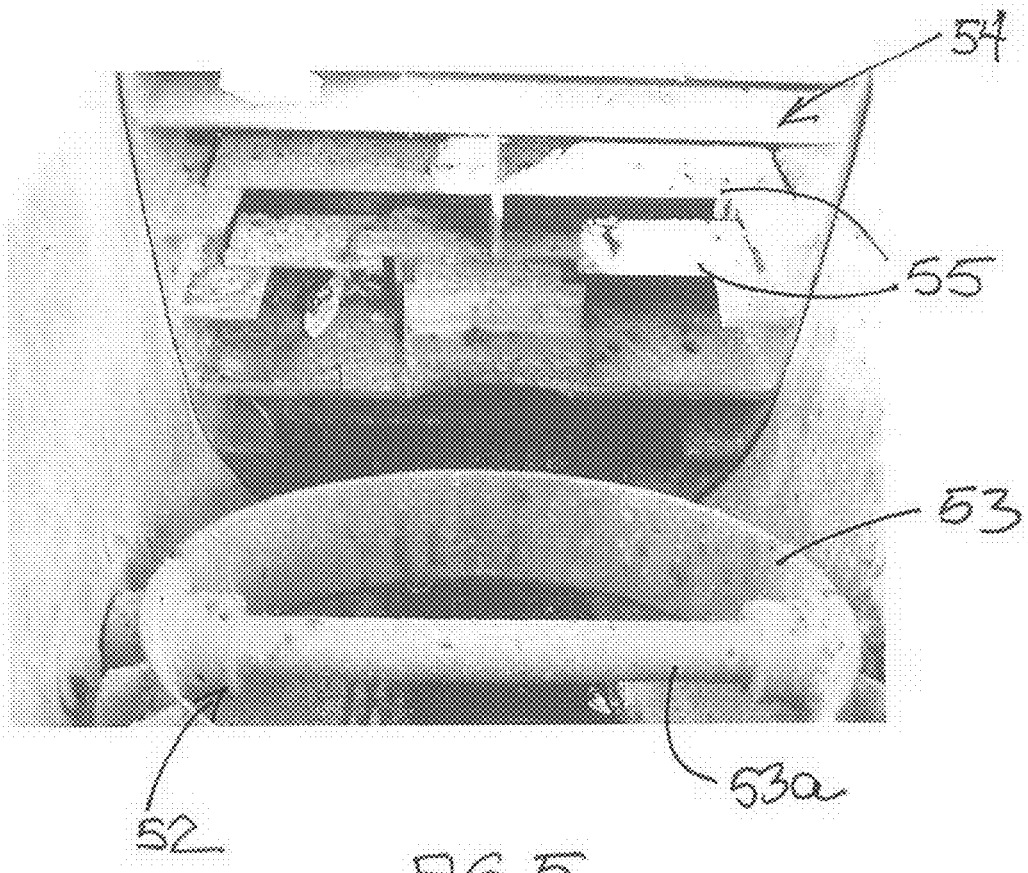
FIG. 5 is a partial perspective view of a filter and chopping portion of the embodiment illustrated in FIG. 1.

With continued reference to FIG. 1 and to FIG. 5, the chopper 52 is carried at the second end 24 of the trough 12 and is positioned for receiving the diluted sludge 28*d* from the trough 12. Alternatively, a filter 54 including slats 55 is positioned between the second end 24 of the trough 12 and the chopper 52 for allowing a preselected size of sludge 28*e* to enter the chopper wherein a chopping of the sized sludge 28*e* takes place for providing a chopped sludge 28*f*. The slats 55 are located between the auger 26 and the chopper 52 to prevent large clods of sludge material from entering the chopper. For the embodiment herein illustrated by way of example, the slats 55 are generally horizontal. In addition, for the embodiment herein described by way of example, the chopper 52 includes a circular blade 53 having a shaft 53*a* through its center to power it for chopping the sludge 28*e* as it enters the chopper and has been shown to further reduce particle size of the processed sludge thus improving the fluidizing process. The blade 53 is desirably sharp and the shaft 53*a* supported by bearings.

Figure 6:
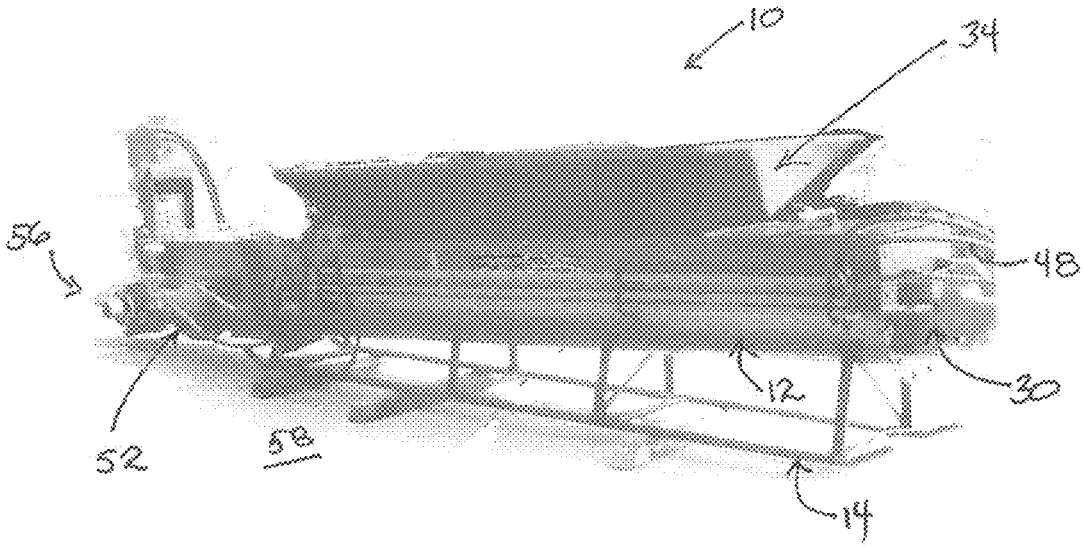
FIG. 6 is a perspective view of one commercial embodiment of the apparatus of FIG. 1.
Figure 1:
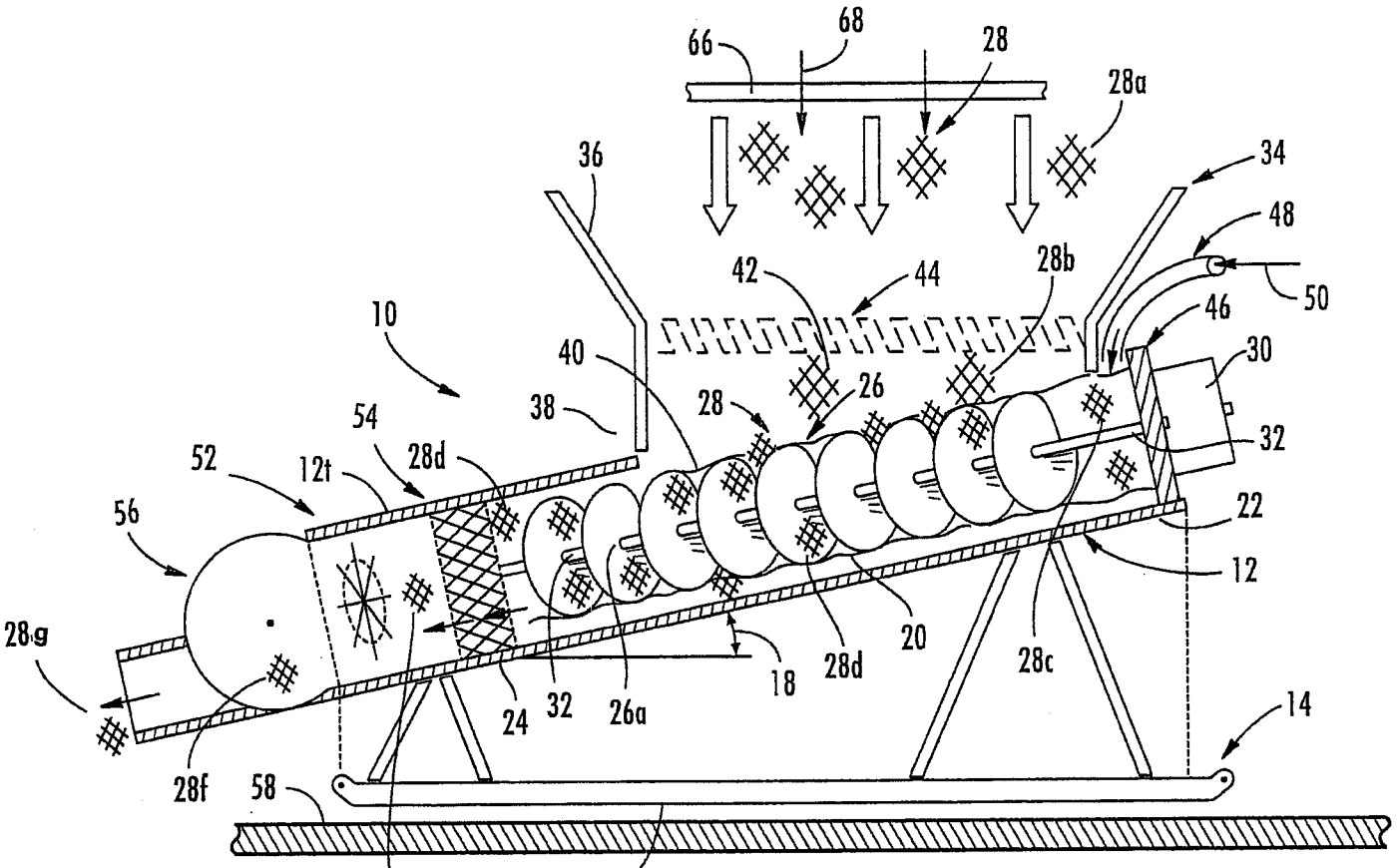
Figure 2:
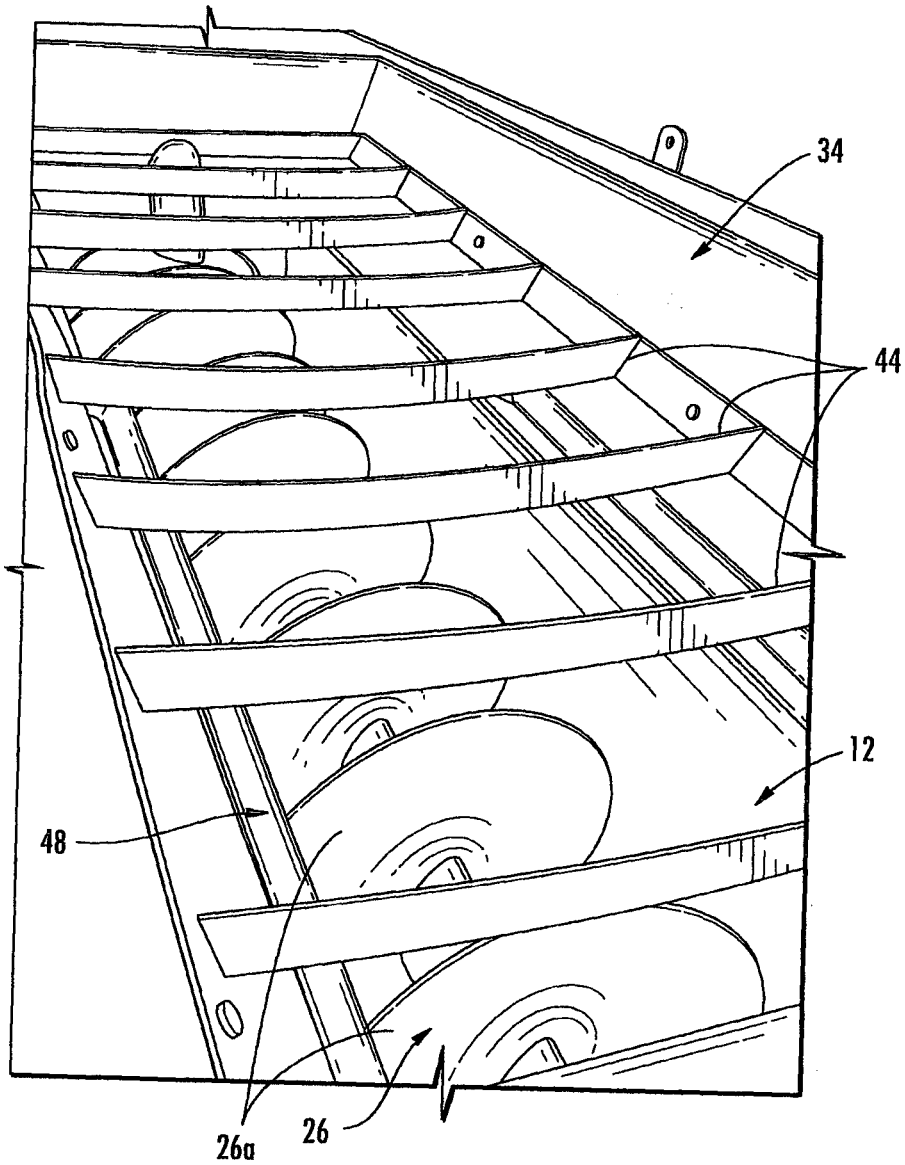
Figure 3:
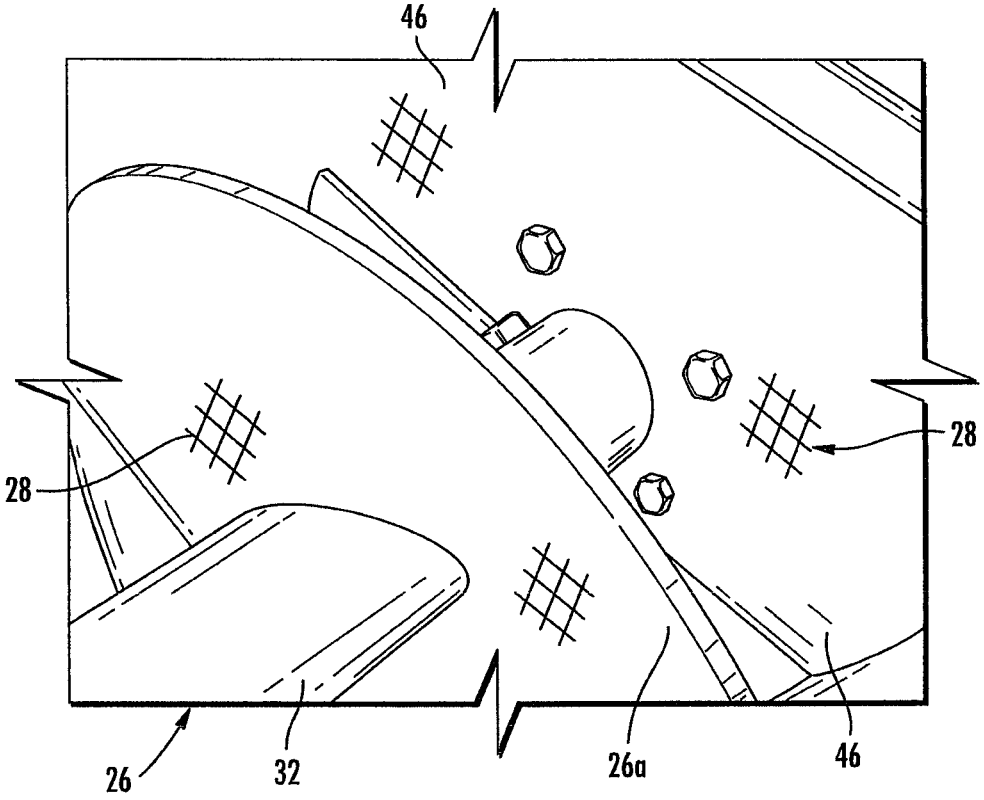
Figure 4:
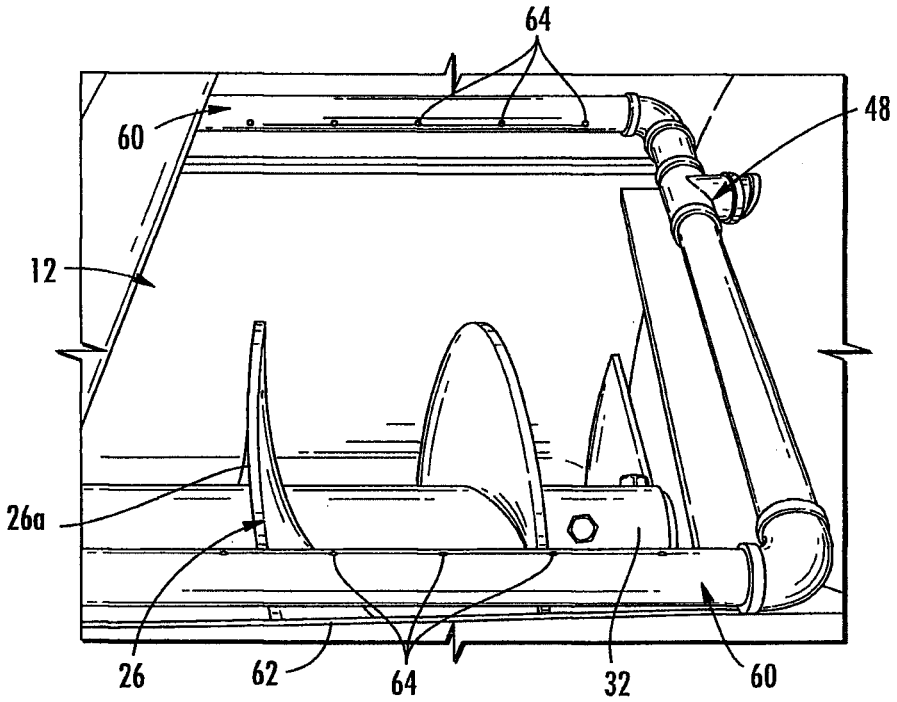
Figure 5:
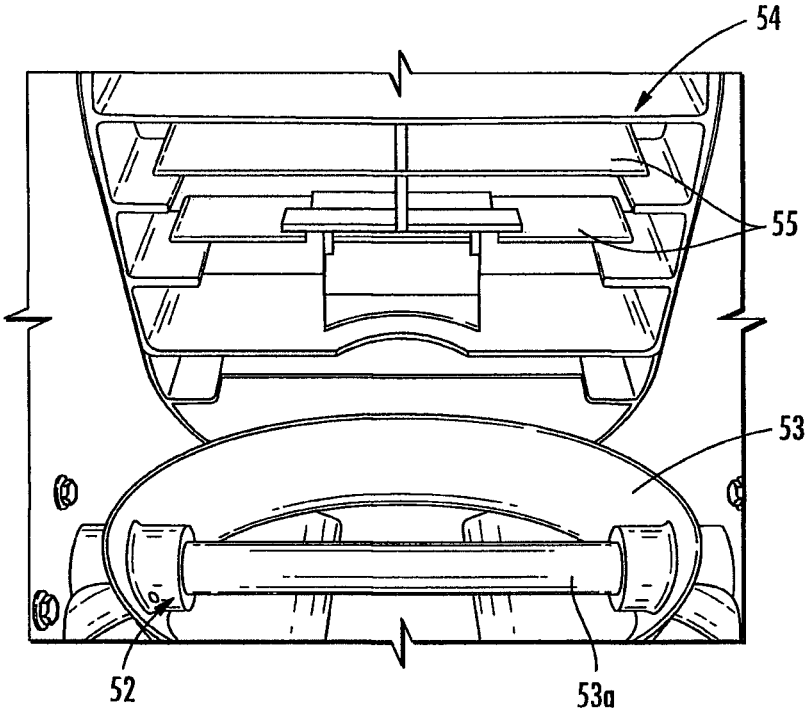
Figure 6:
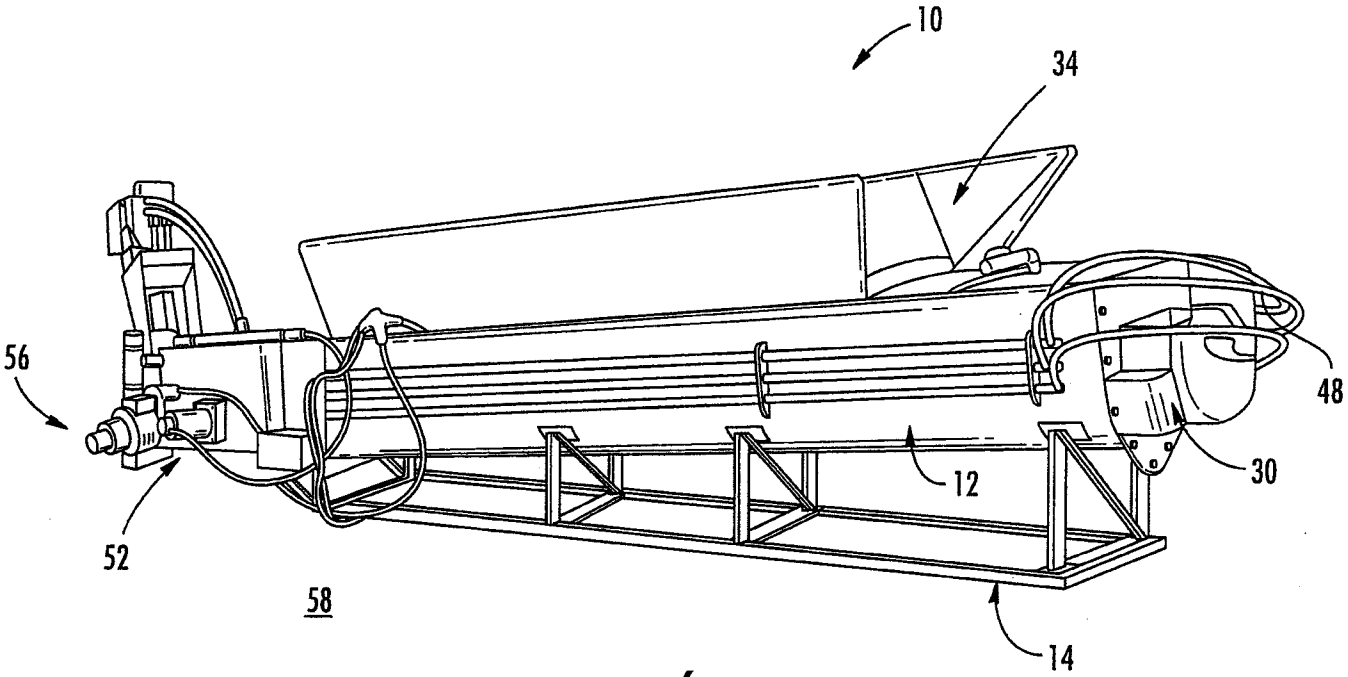

As will be understood by those of ordinary skill in the art, the terminology used for the sludge during its processing is arbitrary and is intended to aid the reader is appreciating stages in the processing of the sludge 28. With continued reference to FIG. 1 and to FIG. 6, a pump 56 receives the sludge chopped sludge 28*f* from the chopper 52 for removing the sludge 28 from the apparatus 10.

For one desirable embodiment as herein described with reference to FIG. 1, by way of example, the hopper 34, the trough 12, the chopper 52, the pump 56, and appropriately related operating additional elements are all carried by the skid 14. The skid 14 (typically a skid runner pair) extends generally a full length of the trough 12 for providing a desirable surface contact with a supporting surface 58, as further illustrated with reference again to FIG. 6 for one commercial embodiment of the apparatus 10.

As will be understood now having an understanding of one embodiment of the invention, a method aspect of the invention includes processing sludge 28 using the portable apparatus 10*b* as above described. With reference again to FIG. 1, one method of processing material such as sludge 28 may comprise depositing the raw sludge 28*a* to be processed into the hopper 34, directing the material into the trough 12 at a location 42 generally between the upstream and downstream ends 22, 24, and operating the auger 26 at a rotational speed and direction so as to force the sludge 28 received within the trough 12 upstream. As above described, passing the raw sludge 28*a* through the cutter blades 44 produces the cut sludge 28*b*. The process continues to operate the auger 26 for forcing the sludge 28 against the plate 46, an upstream end of the trough 12, for a breaking up the sludge 28 into further processed broken up sludge 28*c*. The auger 26, unlike a typical use, is herein used as a means for breaking up the sludge, typically in a hard and difficult state fro pumping into a slurry state useful for pumping. The cutting/diluting fluid 50 is added to the trough 12 for diluting the broken sludge 28*c* and enhancing a flow of the diluted sludge 28*d* downstream toward the trough second end 24 through a gravitational force.

Again, typically an auger is used to convey material in a direction toward a deposition, unlike here where the auger 26 is used to process the sludge and gravity is used to convey the material downstream as a result of the inclined (angle of inclination 18) trough 12. Operation of the apparatus 10 provides for reversing the rotational direction of the auger 26 to enhance flow downstream typically under jammed conditions or to accelerate the downstream flow. The diluted sludge 28*d* may then be filtered to allow the preselected sized sludge 28*e* to be chopped into chopped sludge 28*d* for pumping the chopped sludge 28*f* a desired location.

By way of further example, in the pulp & paper industry, water injection is used as a cutter—stock for most sludge. When water is used as the diluting fluid 50 in black liquor sludge, hot diluting fluids may be employed to form a soluble mixture of the sludge and diluting fluid. However, within certain limits other liquids such as diesel fuel, kerosene, and the like may be used in other applications.

Hydraulic motors may be employed to power the chopper and the auger. The speeds of rotation adjustable by an operator. By way of example, hydraulic driven positive displacement and slurry pumps may be depending on the product. Positive-displacement pumps help break up the solids and are used when additional breakup and blending of the sludge material is desired. In this manner the processed sludge is removed through a hose.

As a practical note, the apparatus 10 while herein described for use in fluidizing typically dry/hard sludge 28 such as black liquor found in tank bottoms used in the pulp and paper industry, it will come to the mind of those skilled in the art that other uses in other somewhat similar situations are possible. By way of example, operation of the apparatus 10 will quickly fluidize softer sludge typically found in tank bottoms of oil tanks of the petroleum industry. Such tanks are found in oil terminals and their customers who use the #6 oil as an energy source in boilers. The mobility of the apparatus 10, assisted by skids, is desirable for placement in tanks and moats where the sludge accumulates and is an ideal location for liquefying and recycling the sludge. The inclined trough 12 allows the fluidized material to gravity-flow to the lower end for discharge while solidified portions of the sludge continues to be compressed, broken up and shredded until it is liquefied as well.

Several features aid in particle reduction and fluidizing of the sludge, including sharpened blades of the hopper. These blades chop any large clumps that are placed into the hopper prior to their entry into the auger. A loader bucket 66 may be used to place the sludge into the hopper and may be used to force 68 clumps of sludge through the blades 44. As above describe, at the auger 26 end portion at the trough second end 24 and proximate the chopper 52, horizontal blades may be employed for the filter slats to regulate the size of any material that enters the chopper 52.

With the mobility of the unit around the work area hydraulic power is preferred to give the machine adequate power to rotate the auger, the chopper, and the pump. A radial piston hydraulic motor provides adequate power and has been proven to be desirable for the auger and the chopper.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus comprising:

a platform;

a trough carried by the platform, the trough inclined at an angle sufficient for permitting fluid to flow downstream from a first elevated end to a second end as a result of gravitational forces;

an auger carried within the trough and generally extending between the first and second ends for conveying sludge placed within the trough;

a drive assembly carried at the first end of the trough, the drive assembly including a motor connected to the auger for controlling a speed and direction of rotation thereof and thus a flow of the sludge;

a hopper positioned for receiving the sludge at a top end thereof and dispensing the sludge from a bottom end thereof into the trough at a location generally between the first and second ends thereof;

cutter blades fixed between the top and bottom ends of the hopper, the cuter blades receiving the sludge passing through the hopper and cutting the sludge as a result of the sludge falling through the cutter blades under gravitational forces;

a plate positioned at the trough first end for receiving the sludge driven against the plate by operation of the auger, wherein the sludge is broken up through action of the auger forcing the sludge against the plate;

a fluid injector positioned for injecting a fluid into the trough for diluting the sludge being processed therein;

a chopper carried at the second end of the trough for receiving the sludge from the auger for a chopping of the sludge;

a filter including slats positioned between the second end of the trough and the chopper for allowing a preselected size of sludge to enter the chopper; and a pump positioned for receiving the sludge from the chopper for removing the sludge therefrom.

2. An apparatus according to claim 1, further comprising an injection system delivering a liquid into the trough for mixing the liquid with the sludge.

3. An apparatus according to claim 1, wherein the platform comprises a skid dimensioned for permitting a sliding movement to the portable apparatus.

4. An apparatus according to claim 1, wherein the hopper extends along a substantial portion of the auger convey longitudinal axis.

5. An apparatus according to claim 1, wherein the slats comprise horizontal slats.

6. An apparatus according to claim 1, wherein the chopper section comprises a circular chopping blade for chopping the sludge.

7. A method of processing sludge using a portable apparatus having a trough carried by skids at an inclined angle so as to have an upstream end and a downstream end permitting a fluid flow as a result of gravity, an auger operable within the trough, a hopper positioned for depositing sludge into the auger, a chopper carried downstream the auger, wherein a discharge of material processed within the trough is made, a filter including slats positioned between the discharge and the chopper, and a pump receiving the discharge and pumping the discharge therefrom, the method comprising:

depositing material to be processed into the hopper;

directing the material into the trough at a location generally between the upstream and downstream ends;

operating the auger at a rotational speed and direction so as to force the material received within the trough upstream:

continuing to operate the auger for forcing the material against an upstream end surface of the trough for a breaking up thereof;

adding fluid to the trough for diluting the material and enhancing a flow of the broken up material downstream;

chopping the dilute material to a desired consistency;

filtering the chopped material; and pumping the filtered material to a desired location.

8. A method according to claim 7, comprising injecting a liquid into the material for modifying the consistency thereof.

9. A method according to claim 7, comprising reversing the rotation of the auger so as to enhance flow of the material downstream.

10. A method according to claim 9, comprising further injecting a liquid into the material for modifying the consistency thereof and alternately reversing the rotation of the auger until a desired consistency of the material is obtained.

11. A method according claim 7, wherein the liquid injecting comprises injecting water.

12. A method of processing sludge using a portable apparatus having a trough inclined so as to have an upstream end and a downstream end permitting a fluid flow as a result of gravity, an auger operable within the trough, a chopper carried downstream the auger, wherein a discharge of material processed within the trough is made, and a pump receiving the discharge and pumping the discharge therefrom, the method comprising:

depositing material to be processed into the trough at a location generally between the upstream and downstream ends;

operating the auger at a rotational speed and direction so as to force the material received within the trough upstream;

continuing to operate the auger for forcing the material against an upstream end surface of the trough for a breaking up thereof;

adding fluid to the trough for diluting the material and enhancing a flow of the broken up material downstream under a force of gravity;

allowing the diluted material flowing downstream to enter the chopper;

chopping the diluted material to a desired consistency; and pumping the chopped material to a desired location.

13. A method according to claim 12, further comprising filtering the diluted material prior to the chopping.

14. A method according to claim 12, further comprising positioning a hopper for receiving the material and depositing the material to be processed into the hopper for the depositing into the trough.

15. A method according to claim 12, further comprising cutting the material prior to depositing the material into the trough.

16. A method of processing sludge, the method comprising:

providing a skid;

attaching a trough to the skid at an inclined angle sufficient for permitting fluid to flow downstream from an elevated first end to a lower second end as a result of gravitational forces, the trough having a rigid surface fixed upstream therein at the first end;

positioning an auger within the trough, the auger having a length dimension generally extending between the first and second ends for conveying sludge therebetween;

controlling a speed and direction of rotation of the auger and thus a flow of the sludge;

positioning a hopper for receiving sludge at a top end and dispensing the sludge from a bottom end into the trough at a location generally between the first and second ends thereof;

fixing cutter blades between the top and bottom ends of the hopper dumping sludge to be processed into the hopper for allowing the sludge to pass through the cutter blades for a cutting thereof;

operating the auger for conveying the cut sludge upstream and against the rigid surface and breaking up the sludge through action of the auger forcing the sludge against the rigid surface:

injecting a fluid into the trough for diluting the sludge broken up and cut sludge being processed therein and enhancing flow of diluted sludge downstream toward the second end;

filtering the diluted sludge through slats positioned between the second end of the trough and a chopper for allowing a preselected size of sludge to enter the chopper;

receiving the diluted sludge within a chopper carried at the second end of the trough for chopping the diluted sludge; and pumping the filtered sludge for removal thereof.

* * * * *

UNITED STATES PATENT AND TRADEMARK OFFICE

CERTIFICATE OF CORRECTION

PATENT NO. : 8,017,021 B1
APPLICATION NO. : 12/325296
DATED : September 13, 2011
INVENTOR(S) : Wesley A. Staples It is certified that error appears in the above-identified patent and that said Letters Patent is hereby corrected as shown below:

Delete the title page showing an illustrative figure and substitute the attached title page therefor.

Replace Sheets 1 of 6 through 6 of 6 containing informal drawings for FIGS. 1-6 and insert Replacement Sheets 1 of 6 through 6 of 6 with formal drawings for FIGS. 1-6.

Signed and Sealed this
Twenty-fifth Day of October, 2011

David J. Kappos

David J. Kappos
*Director of the United States Patent and Trademark Office*

(12) United States Patent
Staples

(10) Patent No.: US 8,017,021 B1
(45) Date of Patent: Sep. 13, 2011

(54) SLUDGE PROCESSING APPARATUS AND METHOD

(76) Inventor: Wesley A. Staples, Palatka, FL (US)

( * ) Notice: Subject to any disclaimer, the term of this patent is extended or adjusted under 35 U.S.C. 154(b) by 70 days.

(21) Appl. No.: 12/325,296

(22) Filed: Dec. 1, 2008

Related U.S. Application Data

(63) Continuation-in-part of application No. 11/345,607, filed on Feb. 1, 2006, now abandoned.

(51) Int. Cl.
*B02C 19/00* (2006.01)

(52) U.S. Cl. ..... 210/773; 210/173; 241/21; 241/29; 241/78; 241/152.2; 241/260.1

(58) Field of Classification Search ..... None
See application file for complete search history.

(56) References Cited

U.S. PATENT DOCUMENTS

| | | | | | |
|---|---|---|---|---|---|
| 2,098,026 | A | * | 11/1937 | Booge et al. | 423/83 |
| 2,635,104 | A | * | 4/1953 | Chayen | 554/23 |
| 2,929,504 | A | | 3/1960 | Lind et al. | |
| 3,168,291 | A | * | 2/1965 | Knoedler et al. | 366/142 |
| 3,355,260 | A | * | 11/1967 | Bruniche-Olsen | 127/43 |
| 3,547,577 | A | * | 12/1970 | Lovercheck | 53/511 |
| 3,565,634 | A | * | 2/1971 | Österman | 426/417 |
| 3,659,712 | A | | 5/1972 | Chaplin | |
| 3,711,296 | A | * | 1/1973 | LaWarre, Sr. | 426/499 |
| 3,756,372 | A | | 9/1973 | Mertens | |
| 3,766,586 | A | * | 10/1973 | Krickovich | 15/83 |
| 3,906,118 | A | * | 9/1975 | McFarland | 426/479 |
| 3,956,981 | A | * | 5/1976 | Pitt | 100/39 |
| 4,152,800 | A | | 5/1979 | Nilsmar | |
| 4,234,232 | A | * | 11/1980 | Smith et al. | 299/5 |
| 4,306,967 | A | | 12/1981 | Trautwein | |
| 4,357,230 | A | * | 11/1982 | Sibley et al. | 208/390 |
| 4,404,101 | A | | 9/1983 | Koch et al. | |
| RE31,631 | E | * | 7/1984 | McFarland | 241/74 |
| 4,464,246 | A | * | 8/1984 | Sanda | 208/428 |
| RE32,050 | E | * | 12/1985 | McFarland | 426/479 |
| RE32,060 | E | * | 12/1985 | McFarland | 426/55 |
| 4,588,559 | A | * | 5/1986 | Emmett | 422/162 |
| 4,634,524 | A | | 1/1987 | Huber | |
| 4,642,919 | A | | 2/1987 | Werner et al. | |
| 4,776,112 | A | | 10/1988 | Urbani | |
| 4,836,919 | A | | 6/1989 | Huber | |
| 4,871,449 | A | | 10/1989 | Lott | |
| 4,957,622 | A | | 9/1990 | Mims | |
| 5,007,590 | A | * | 4/1991 | Taylor | 241/25 |
| 5,028,010 | A | * | 7/1991 | Sansing | 241/101.8 |
| 5,048,766 | A | * | 9/1991 | Gaylor et al. | 241/65 |
| 5,167,841 | A | | 12/1992 | Mims | |
| 5,188,729 | A | | 2/1993 | Krofta | |

(Continued)

*Primary Examiner* — Robert James Popovics
(74) *Attorney, Agent, or Firm* — Allen, Dyer, Doppelt, Milbrath & Gilchrist, P.A.

(57) ABSTRACT

Material to be processed, such as sludge, is deposited into the trough having an auger operating at a rotational speed and direction so as to force the material received within the trough upstream against a rigid surface for breaking up the sludge. A cutting fluid is added to the trough for diluting the sludge and enhancing a flow of the broken up sludge downstream under a force of gravity, allowing the sludge to enter a chopper, where it is chopped to a desired consistency before being pumped to a desired location. The diluted sludge may be filtered prior to chopping. A hopper and cutter may be used to receive the unprocessed sludge for cutting prior to being deposited into the trough. As a result, sludge in ranges from soft to hard states is converted to a fluid form capable of being pumped.

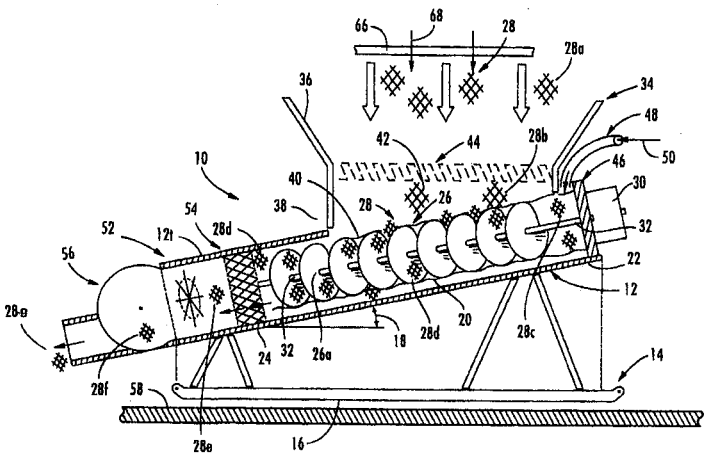

16 Claims, 6 Drawing Sheets